United States Patent [19]

Gertz

[11] 3,930,797

[45] Jan. 6, 1976

[54] AIR TREATMENT DEVICE

[76] Inventor: Albert E. Gertz, 9232 Alcona St., Lanham, Md. 20801

[22] Filed: July 23, 1974

[21] Appl. No.: 491,058

[52] U.S. Cl. ..... 21/122; 21/53; 21/74 R; 98/30; 98/109

[51] Int. Cl.[2] .... A61L 9/04; F24F 3/12; A61L 3/00; F24F 13/16

[58] Field of Search ..... 21/74 R, 53, 122, 127, 21/119, 126, 55; 98/30, 105, 107, 109; 236/93, 44 R

[56] References Cited

UNITED STATES PATENTS

| | | | |
|---|---|---|---|
| 234,369 | 11/1880 | Bucher | 98/109 |
| 2,460,335 | 2/1949 | Bass | 21/127 |
| 2,867,866 | 1/1959 | Steele | 21/126 |
| 3,290,112 | 12/1966 | Gillenwater et al. | 21/122 |
| 3,419,217 | 12/1968 | White et al. | 98/109 |
| 3,474,598 | 10/1969 | Keuls | 98/105 |
| 3,576,593 | 4/1971 | Cicirello | 21/55 |
| 3,661,323 | 5/1972 | Farris | 21/74 R |
| 3,694,146 | 9/1972 | Roy et al. | 21/119 |
| 3,820,308 | 6/1974 | Onuki | 21/53 |

*Primary Examiner*—Barry S. Richman
*Assistant Examiner*—Dale Lovercheck
*Attorney, Agent, or Firm*—Robert G. McMorrow

[57] ABSTRACT

A container is mounted in an air duct, the container having an open top and adjustable opening means on the opposite side. An air dispersible substance is placed in the container and is released into the air stream of the duct according to the degree of opening of the opening means.

1 Claim, 5 Drawing Figures

AIR TREATMENT DEVICE

BACKGROUND OF THE INVENTION

1. Field of the Invention

This invention relates to means for treating the air in a duct, for example, the placement of an air freshener chemical in an air conditioning or heating duct.

2. Statement of Prior Art

Air treatment means with screen enclosures, and the like, incorporated in duct work, have been previously proposed. Examples of such prior proposals are found in the following patents:

| Patent No. | Patentee | Issue Date |
|---|---|---|
| 60,394 | Lockwood | Dec. 11, 1866 |
| 257,104 | Tayman | Apr. 25, 1882 |
| 402,714 | Benson | May 7, 1889 |
| 441,573 | Macdonald | Nov. 25, 1890 |
| 1,310,511 | Summers | July 22, 1919 |
| 1,932,379 | Ballentine | Oct. 24, 1933 |
| 2,460,335 | Buss | Feb. 1, 1949 |
| 2,585,339 | Miller | Feb. 12, 1952 |
| 3,055,066 | Duncan | Sept. 25, 1962 |
| 3,138,432 | Kleinhans | June 23, 1964 |
| 3,178,255 | Neuwald et al | Apr. 13, 1965 |
| 3,418,068 | Gilbertson | Dec. 24, 1968 |

SUMMARY OF THE INVENTION

The present invention provides a convenient and noncomplex means for the introduction of air dispersible chemicals, such as deodorants, air fresheners, perfumes, insecticides or the like into a building or other enclosure. Many buildings are provided with a duct system which normally is used for heating and/or air conditioning. The device hereof is readily incorporated in such existing duct work without major modification or disturbance thereof.

The invention comprises a container mounted in the duct, and provided with an access door. Moreover, the device includes an adjustable lower grate which permits modification of the rate of release of the substance to be distributed. Thus, the user may experimentally determine a correct grate opening to provide the degree of distribution of the substance desired.

Other and further objects and advantages of the invention will become apparent to those skilled in the art from a consideration of the following specification when read in conjunction with the annexed drawing.

DESCRIPTION OF THE PREFERRED EMBODIMENT

Figure 1:
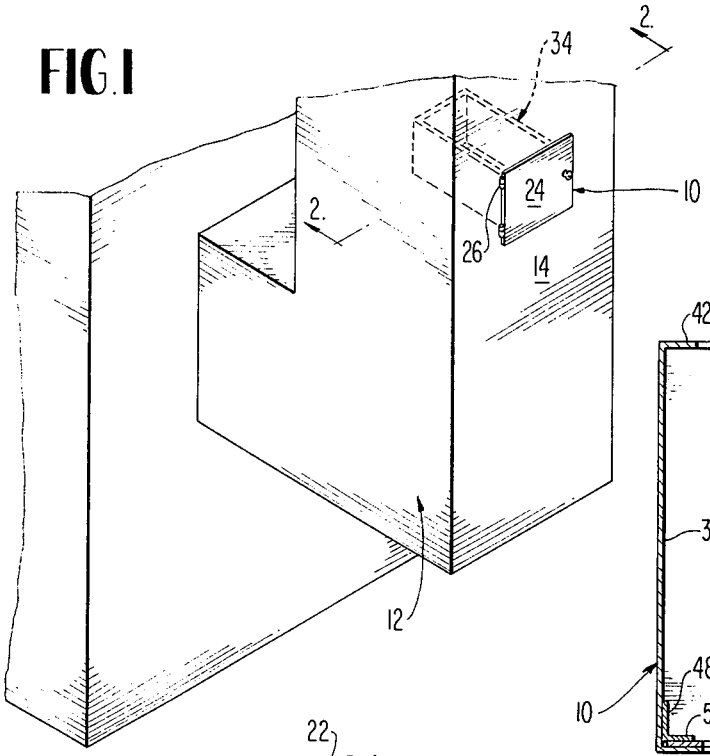
FIG. 1 is a perspective view showing a partial section of duct with an air treatment device according to this invention in place therein.
Figure 2:
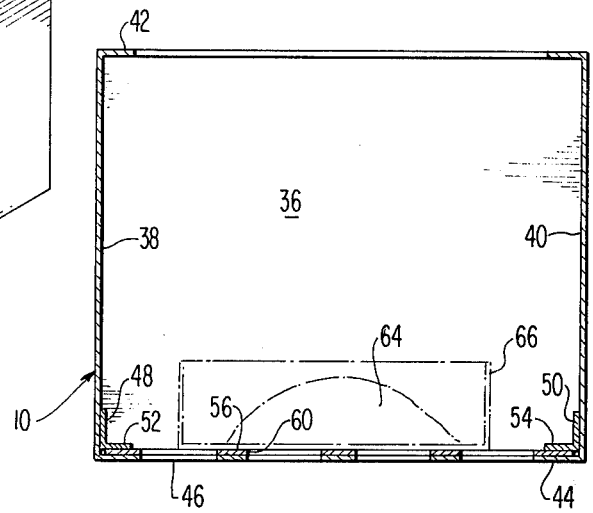
FIG. 2 is an enlarged cross sectional view of the device per se, taken on line 2—2 of FIG. 1, looking in the direction of the arrows.
Figure 3:
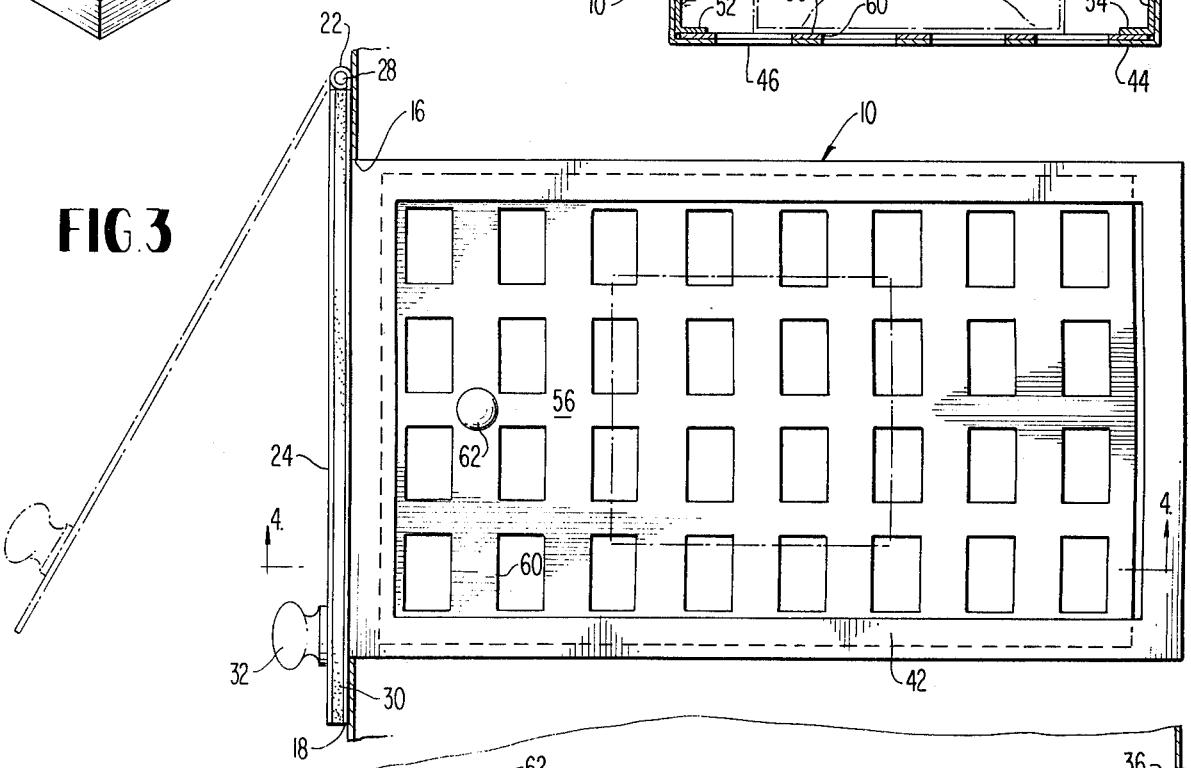
FIG. 3 is a top elevational view of the unit of FIG. 2, showing the access door in open position in phantom lines.

The environment of this invention is best illustrated in FIG. 1 wherein a unit hereof is generally identified by reference character 10. The unit 10 is mounted in an air movement duct 12 adjacent a blower means such as a heater or air conditioner. The duct, for purposes of description here, has an outer duct wall 14 formed of sheet metal or the like. In FIG. 3, it will be observed that an opening 16 is formed in the duct wall, the opening being of a size sufficient to admit the main portion of the unit.

A substantially rectangular open frame face plate 18 is fixedly secured to the duct wall about the opening 16. The face plate defines a port 20 aligned with the opening 16. A series of hinge sleeves 22 project from one side of the face plate. Access to the unit is provided via a door 24 which is of a configuration to fit over the port 20. The door has hinge sleeves 26 aligned with the sleeves 22, and hinge pins 28 extend therethrough. The interior side of the door may be provided with a resilient seal 30 to prevent air loss therethrough when closed. A handle 32 of any convenient type is applied to the outer side of the door.

A main enclosure or box 34 is secured to the face plate and extends therefrom into the airstream portion of the duct. The box has an imperforate back wall 36, imperforate side walls 38,40, and an open top frame 42. An important feature of the invention resides in the construction and operation of the base wall assembly. This assembly includes a fixed lower base wall 44 secured to the side and back walls. The lower base wall has a series of generally rectangular holes 46 formed therein and arranged in columns and rows throughout the extent thereof.

A pair of elongated, L-shaped flange members 48 and 50 is provided. Each flange member has a vertical portion fixedly secured to the box side wall, and a horizontal foot portion 52 and 54, respectively, said foot portions projecting inwardly over the lower base wall in upwardly spaced relation thereto. The second major component of the base wall assembly is an upper base wall 56. The wall 56 has a lip 58 at one end, and has a series of holes 60 arranged in columns and rows and of identical size and shape as the holes 46. A handle 62 projects upwardly from the upper base wall, the wall being slidable longitudinally under the foot members 52 and 54.

Figure 4:
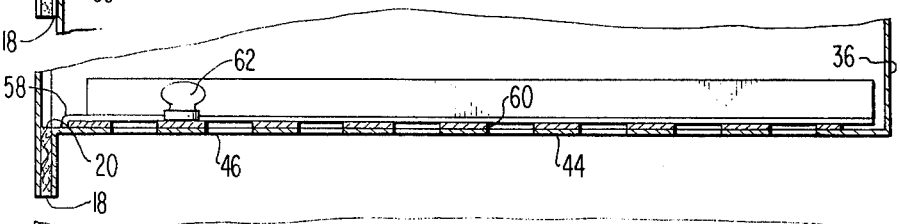
FIG. 4 is a sectional view showing details of the grate, taken on line 4—4 of FIG. 3, looking in the direction of the arrows.
Figure 5:
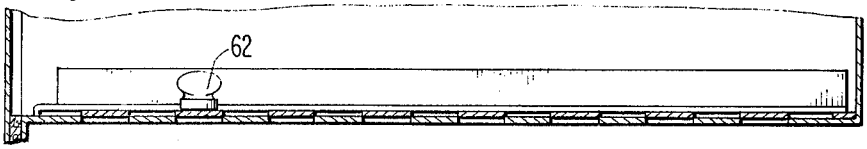
FIG. 5 is a view similar to FIG. 4 showing the grate fully closed.

In FIG. 4, the holes 46 and 60 are in full registry, permitting unrestricted air passage therethrough. In FIG. 5, the upper base wall has been longitudinally adjusted to completely misalign the holes, thereby fully closing the box to air passage. Of course, intermediate locations may be selected to vary the air flow.

A quantity 64 of an air dispersible substance of any suitable type is positioned in the box, for example in a screen enclosure 66 on the upper base wall. Such material is emitted into the airstream when the grate is fully or partially open. This in turn causes the substance to be distributed throughout the duct work system and ultimately into the areas served by the duct work.

I claim:

1. In combination, with an air duct having a duct wall, said wall having an opening therein, an air treatment device comprising:

A substantially rectangular face plate fixedly secured to the duct wall, the face plate defining a port, and the port being aligned with the opening in the duct wall;

hinge sleeves on one side of the face plate;

an imperforate door configured to fit over the face plate, the door having hinge sleeves on one side thereof aligned with the hinge sleeves of the face plate;

hinge pins extending through the aligned hinge sleeves, and hingedly connecting the door to the face plate, the door being movable from a pivoted open position providing access through the port and opening to a closed position over said port;

a box secured to the face plate and projecting through the opening into the duct;

the box having an imperforate back wall, imperforate side walls, and an open top frame;

the box further having a lower base wall secured to the side and back walls;

a pair of L-shaped flange members, one of said flange members being secured to each of the side walls, the flange members including horizontal foot portions which extend upwardly in closely spaced relation to the lower base wall;

an upper base wall mounted for a limited sliding movement within the box between the lower base wall and the foot portions of the flanges;

the upper base wall having a handle thereon to facilitate sliding movement thereof;

the upper and lower base walls each having a series of holes formed therein, said holes being spaced apart and having imperforate sections therebetween, the holes of the respective walls being selectively alignable and movement of the upper base wall serving to fully close, fully or partially align the holes; and a quantity of air dispersible substance in an enclosure, said substance being conveyed through the duct when the holes are fully or partially aligned, said enclosure being supported on the upper base wall.

* * * * *